US006211127B1

(12) United States Patent
Kim et al.

(10) Patent No.: US 6,211,127 B1
(45) Date of Patent: Apr. 3, 2001

(54) PHOTORESIST STRIPPING COMPOSITION

(75) Inventors: Jin-Seock Kim, Seoul; June-Ing Kil, Kyungki-do; Dong-Jin Park, Kyungki-do; Shang-Oa Park, Kyungki-do; Chun-Duek Lee, Kyungki-do; Seog-Young Lim, Kyungki-do; Yang-Sun Kim, Kyungki-do, all of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/330,206

(22) Filed: Jun. 11, 1999

(30) Foreign Application Priority Data

Jul. 10, 1998 (KR) ..... 98-27782

(51) Int. Cl.[7] ..... C11D 9/04

(52) U.S. Cl. ..... 510/176; 510/175; 510/484; 510/493; 510/502; 510/506

(58) Field of Search ..... 510/175, 176, 510/484, 493, 502, 506; 430/256, 258, 331; 438/612; 134/38, 39, 40, 41

(56) References Cited

U.S. PATENT DOCUMENTS

| | | | | |
|---|---|---|---|---|
| 4,617,251 | * | 10/1986 | Sizensky | 430/256 |
| 5,480,585 | * | 1/1996 | Shiotsu et al. | 252/544 |
| 5,567,574 | * | 10/1996 | Hasemi et al. | 430/331 |
| 5,597,678 | * | 1/1997 | Honda et al. | 430/331 |
| 5,731,243 | * | 3/1998 | Peng et al. | 438/612 |
| 5,795,702 | * | 8/1998 | Tanabe et al. | 430/331 |
| 5,988,186 | * | 11/1999 | Ward et al. | 134/1.3 |

FOREIGN PATENT DOCUMENTS

| | | | | |
|---|---|---|---|---|
| 07276504 | * | 4/1997 | (JP) | C11D/7/32 |

* cited by examiner

*Primary Examiner*—Yogendra Gupta
*Assistant Examiner*—Gregory E Webb
(74) *Attorney, Agent, or Firm*—Howrey Simon Arnold & White, LLP

(57) ABSTRACT

A photoresist stripping composition suitable for both of the single wafer treatment method using an air knife process and a dipping photoresist stripping method. The composition comprises 5–15 weight % of alkanolamine, 35–55 weight % of sulfoxide or sulfone compound and 35–55 weight % of glycolether, and preferably further includes surfactant, and also 1–10 weight % of tetra methyl ammonium hydroxide or 3–15 weight % of benzenediol and 1–15 weight % of alkylsulfonic acid.

9 Claims, 2 Drawing Sheets

PHOTORESIST STRIPPING COMPOSITION

BACKGROUND OF THE INVENTION (1) Field of the Invention

The present invention relates to a photoresist stripping composition for removing photoresist in manufacturing of a device circuit of a liquid crystal display panel, and more particularly, to a photoresist stripping composition designed for a single wafer treatment method utilizing an air knife process as well as the dipping photoresist stripping process.

(2) Description of the Related Art

A semiconductor integrated circuit and a device circuit of a liquid crystal panel have very fine structures. The fine circuits are generally fabricated by uniformly coating a photoresist on an insulating film or a conductive metal film (such as an oxide film or an Al alloy film respectively), coated on a substrate, and exposing and developing the photoresist to form a certain pattern, and etching the metal film or insulating film by using the patterned photoresist as a mask, and thereafter, by removing the unnecessary photoresist.

A photoresist stripping composition is used in removing the photoresist from a substrate. In general, the stripping composition should have a high stripping force at both low and high temperatures, and should leave no residues on the substrate. Further, a desirable stripper should not corrode a metal film, while causing little hazard to both humans and the environment considering the large amount of stripping composition used in fabricating a large-scale liquid crystal display panel circuit.

To meet the above requirements, various photoresist stripping compositions have been suggested. For example, the U.S. Pat. No. 5,480,585 and the Japanese Patent Hei. 5-181753 disclose organic strippers comprising alkanolamine of the structural formula $H_{3-n}N((CH_2)_mOH)_n$ (where m is 2 or 3, and n is 1, 2 or 3), sulfone compound or sulfoxide compound and a hydroxyl compound expressed by the structural formula $C_6H_{6n}(OH)_n$ (where n is 1, 2 or 3). The Japanese Laid-open Patent 4-124668 discloses a photoresist stripping composition including an organic amine of 20–90% by weight, phosphoric ester surfactant of 0.1–20% by weight, 2-butyne-1,4-diol of 0.1–20% by weight, and the remainder glycolmonoalkylether and/or aprotic polar solvent. For the glycomonoalkylether, ethyleneglycolmonoethylether, diethyleneglycolmonoethylether, or diethyleneglycolmonobutylether is used and for aprotic polar solvent, dimethylsulfoxide or N,N-dimethylaceteamide is used. The amount of the 2-butyne-1,4-diol and phosphoric ester surfactant was controlled, to the extent not sacrificing the stripping force, to prevent the corrosion of a metal film such as aluminum and iron.

The Japanese Patent Hei. 8-87118 discloses a stripping composition comprising 50 to 90% by weight of N-alkylalkanolamine and 50 to 10% by weight of dimethylsulfoxide or N-methyl-2-pyrrolidone. It states that even under hard stripping conditions the composition including N-alkylalkanolamine and the organic solvents prevent the formation of non-soluble impurities, and thus, leaves no residues on the substrate.

The Japanese Patent Laid-open Sho. 64-42653 discloses a photoresist stripping composition comprising over 50% by weight of dimethylsulfoxide (more desirably over 70% by weight), 1 to 50% by weight of a solvent selected among diethyleneglycolmonoalkylether, diethyleneglycoldialkylether, γ-butyrolactone and 1,3-dimethyl-2imidazoledinon, and 0.1–5% by weight of nitrogen-including organic hydroxyl compound such as monoethanolamine. It states that the amount of dimethylsulfoxide less than 50% by weight causes great reduction in stripping force, while the amount of nitrogen-including organic hydroxyl compound solvent over 5% by weight corrodes the metal film such as aluminum.

Depending on the constituents of the compositions and the ratio thereof, the aforementioned stripping compositions exhibit greatly different characteristics in photoresist stripping force, metal corrosion properties, the complexities of a rinsing process following the stripping, environmental safety, workability and price. Such varying degrees of characteristics of the stripping compositions have led many researchers to search for the best compositions of maximum capabilities under various processing conditions.

However, the prior research has been largely directed toward developing stripping compositions suitable for the dipping method where the etched semiconductor integrated circuits or the device circuits of a liquid crystal display panel are immersed in a stripping composition to remove the photoresist. Typically, the conventional compositions designed for the dipping method show good chemical properties, such as a good stripping force, non-corrosiveness of metal and safety to humans. Unfortunately, however, these compositions have many shortcomings when used for a single-wafer treatment method using an air knife process, which is gaining an increasing popularity because of the relatively small amount of the stripping composition required. These shortcomings include less stripping force and a corrosion of metal. More importantly, residual impurities are left on the substrate, largely due to the different physical surface characteristics between the bare glass and the insulating or conductive metal film, such as an ITO film, an aluminum, chrome, silicon-nitride film and an amorphous silicon film on which the photoresist is formed.

Accordingly, the photoresist stripping compositions having the properties suitable not only for the dipping method but also for the single-wafer treatment method using an air knife process has a great demand in the industry.

SUMMARY OF THE INVENTION

It is an object of the present invention to provide a stripping composition suitable for both the single wafer treatment method and the dipping method for stripping the photoresist, particularly a composition that leaves no impurities on the substrate even when the single wafer treatment method using an air knife process is applied to strip off the photoresist.

It is another object of the present invention to provide a photoresist stripping composition that has a good stripping force against various kinds of films coated on the substrate, and prevents the formation of impurity particles when cleaning the bare glass.

To achieve the above objects, this invention provides a stripping composition comprising alkanolamine of 5–15% by weight, sulfoxide or sulfone compound of 35–55% by weight and glycolether of 35–55% by weight. Surfactants may be added to the invented composition, in order to prevent the creation and residues of impurity particles on the substrate while rinsing the bare glass.

DETAILED DESCRIPTION OF THE INVENTION

Figure 1:
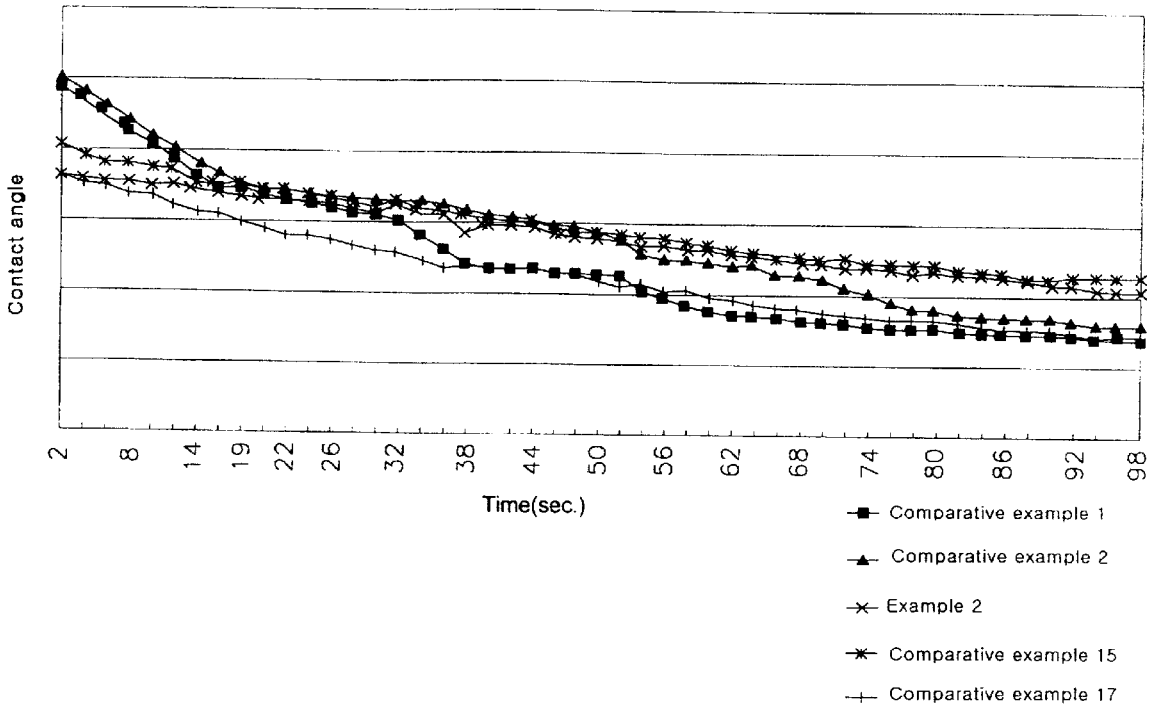
FIG. 1 is a graph showing the change of contact angle between the stripping composition and the LCD layers as time passes after the composition is applied.

In order to be suitable for both of the single wafer treatment photoresist stripping process using high air pressure (air knife) and the dipping process, it is essential that the photoresist stripping composition has a good stripping force and is non-corrosive and forms no impurity particles on the substrate.

To effectively prevent any of impurities on the substrate, the stripping composition should be easily absorbed by various LCD layers, such as an indium tin oxide (ITO) film, an aluminum, chrome, silicon nitride film and an amorphous silicon film. Also, the stripping composition should show a uniformly low surface tension with the LCD layers. Further, it should have a low volatility and viscosity. In addition, the contact angle between the surface of LCD layers and the stripping composition as dropped onto the surface should be small and maintained constant.

In addition, it is desirable that the stripping composition shows uniform physical characteristics against various kinds of LCD layers and that the stripping composition be able to prevent the formation of impurity particles on a bare glass when testing the existence of particles within the LCD manufacturing facilities.

To fulfill the above-mentioned conditions, the present invention provides a stripping composition comprising alkanolamine of 5–15% by weight, sulfoxide or sulfone compound of 35–55% by weight and glycolether of 35–55% by weight. More desirably, it can further include from 0.05 to 0.5 by weight of surfactant in proportion to 100 by weight of the stripping composition.

The alkanolamine strips the photoresist from the substrate. The preferable alkanolamine is monoisopropanolamine [MIPA, $CH_3CH(OH)CH_2NH_2$] or monoethanolamine [MEA, $HO(CH_2)_2NH_2$] and the most desirable alkanolamine is monoethanolamine [MEA, $HO(CH_2)_2NH_2$]. The amount of the alkanolamine is preferably 5–15 weight % based on the total amount of the stripping composition. If the amount of alknolamine is less than 5 weight %, the stripping force of the composition becomes reduced, and impurities are left over on the substrate. If used more than 15 % by weight, it degrades the compositions' characteristic of being absorbed into the LCD layers which increases the contact angle of the composition with the LCD layers and reduces the air-knife photoresist stripping capabilities.

The sulfoxide or sulfone compound is provided as a solvent dissolving the photoresist, and it controls the surface tension between the stripping composition and the LCD layers. It is desirable to use diethylsulfoxide ($C_2H_5SOC_2H_5$), dimethylsulfoxide (DMSO, $CH_3SOCH_3$), diethylsulfone ($C_2H_5SO_2C_2H_5$) or dimethylsulfone ($DMSO_2$, $CH_3SO_2CH_3$) and more desirably dimethylsulfoxide. The amount of the sulfoxide or sulfone compound is 35–55 weight % based on the total amount of the stripping composition. If the amount of the sulfoxide or sulfone compound is less than 35% by weight, the composition is less absorbed into the LCD layers and the increased contact angle between the composition and the LCD layers reduces the air-knife photoresist stripping capabilities. On the other hand, if the amount is used more than 55 weight %, the photoresist stripping force is reduced.

The glycolether serves to, in combination with the aforementioned sulfoxide or sulfone compound, dissolve the photoresist and control the surface tension between the compound and the LCD layers to enhance the air-knife photoresist stripping capabilities much more than the composition consisting of dimethylsulfoxide and monoethanolamine. Even though dimethylsulfoxide by itself serves to enhance the air knife photoresist stripping capabilities, its combination with monoethanolamine greatly reduces the air knife photoresist stripping capabilities. However, the addition of glycolether in the compound consisting of dimethylsulfoxide and monoethanolamine increases both the air-knife photoresist stripping capabilities and the photoresist stripping force of the compound.

The preferable glycolether compound is ethyldiglycol ($C_2H_5(CH_2CH_2O)_2H$), methyldiglycol ($CH_3O(CH_2CH_2O)_2H$), or butyidiglycol (BDG, $C_4H_9O(CH_2CH_2O)_2H$), and the most desirable glycolether is butyldiglycol. The amount of the glycolether is preferably 35–55 weight % based on the total amount of the stripping composition. If the amount of glycolether is less than 35 weight %, the stripping compound is not easily absorbed in the LCD layers, thereby increasing the contact angle, and reducing its air-knife photoresist stripping capabilities. In contrast, if the amount is more than 55 weight %, the photoresist stripping force is reduced.

The surfactant serves to prevent impurities from being left on the bare glass when the particles in facilities are measured. The preferable amount of the surfactant is 0.05–0.5 by weight in proportion to 100 by weight of the stripping composition. If the amount of the surfactant is less than 0.05 by weight or more than 0.5 by weight in proportion to 100 by weight of the stripping composition, it fails to prevent particle formation on the substrate. Since the ITO, Al, Cr, silicon-nitride film and amorphous silicon film show physical properties different from the bare glass, the surfactant is added to the composition to prevent the impurities left over unevenly on the bare glass.

Preferred surfactant to be included in the stripping composition is the compounds of F-14 series (manufactured by Mecapace Co., Japan) or LP100 compounds (ISP Corporation, U.S.A.) having hydrophile and hydrophobic radicals expressed by formula 1 and formula 2 respectively. Here, R represents an alkyl group.

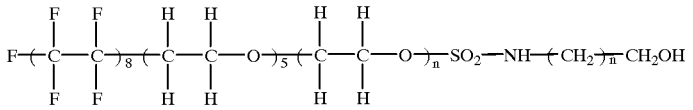

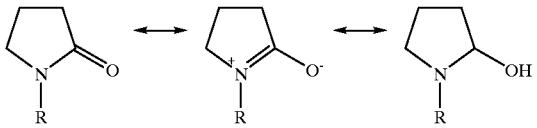

It is desirable that the photoresist stripping composition further includes 1–10 weight % of Tetra Methyl Ammonium Hydroxide (TMAH) or 3–15 weight % of benzenediol in order to eliminate polymers on the bare glass or LCD layers. It is further desirable that the composition include alkylsulfonic acid of 1–15 weight % to help preventing the corrosion of LCD layers.

Some of the preferred embodiments of the present invention are described in detail below. The described embodiments are just examples and do not limit the scope of the present invention.

EXAMPLES 1 TO 3 AND COMPARATIVE EXAMPLES 1 TO 17

Photoresist stripping compounds were prepared mixing the constituents, the proportions of which are as described in Table 1. In Table 1, MIPA and MEA indicate organic amines provided to strip the photoresist that are respectively monoisopropanolamine (MIPA, $CH_3CH(OH)CH_2NH_2$) and monoethanolamine (MEA, $HO(CH_2)_2NH_2$). NMP, DMSO, DMAC, ethyldiglycol, BDG and DPGME are provided as solvents and refer to N-methylpyrrolidone (NMP, $C_5H_9NO$), dimethylsulfoxide (DMSO, $CH_3SOCH_3$), dimethylacetamide (DMAC, $CH_3CON(CH_3)_2$), ethyldiglycol (ethyldiglycol, $C_2H_5O(CH_2CH_2O)_2H$), butyldiglycol (BDG, $C_4H_9O(CH_2CH_2O)_2H$) and dipropyleneglycolmonomethylether (DPGME, $C_7H_{16}O_3$) respectively.

TABLE 1

| (Table I) | MIPA | MEA | NMP | DMAC | DMSO | ethyldiglycol | BDG | DPGME |
|---|---|---|---|---|---|---|---|---|
| Comparative Example 1 | | 15 | | | 55 | 30 | | |
| Com. Exp. 2 | | 20 | | | 55 | | | 25 |
| Com. Exp. 3 | 30 | | | 70 | | | | |
| Com. Exp. 4 | | 30 | | 70 | | | | |
| Com. Exp. 5 | 15 | | 30 | | | | 55 | |
| Com. Exp. 6 | 15 | | 30 | | | 20 | 35 | |
| Com. Exp. 7 | | 3 | | | 47 | | 50 | |
| Com. Exp. 8 | 15 | | | 30 | | | 55 | |
| Com. Exp. 9 | 15 | | | | 30 | | 55 | |
| Com. Exp. 10 | | 15 | 30 | | | | 55 | |
| Com. Exp. 11 | | 15 | | | 30 | | 55 | |
| Com. Exp. 12 | | 15 | | | 20 | | 65 | |
| Com. Exp. 13 | | 15 | | 10 | 15 | | 60 | |
| Com. Exp. 14 | | 15 | | 15 | 15 | | 55 | |
| Com. Exp. 15 | | 15 | | 20 | 15 | | 50 | |
| Com. Exp. 16 | | 10 | 30 | | | | 60 | |
| Example 1 | | 10 | | | 40 | | 50 | |
| Example 2 | | 10 | | | 45 | | 45 | |
| Example 3 | | 10 | | | 50 | | 40 | |

The photoresist stripping force, air-knife photoresist stripping capabilities, contact angle with the surface of the LCD layers, and evaporation rate of each stripping composition are measured by the following methods.

1) Photoresist stripping force

The test wafer was prepared by forming a photoresist layer to the thickness of 1300 Å on a 3 inch bare wafer which had been coated with HMDS (hexamethyldisilane) and baking it for 2 to 3 minutes at the temperatures of 150, 160, 170 and 180° C. It was arranged for the stripping compositions prepared for examples and comparative examples to include 1 weight % of photoresist particles for treating 5000 wafers, whereas for treating 10000 wafers, 2 weight % of photoresist particles were included in the compositions. Thereafter, the stripping compositions were heated at the temperature range of 50 to 70° C. The prepared wafers were dipped in the prepared compositions for 2 to 3 minutes and washed in deionized water for 30 seconds. The results were first observed by a bare eye and later, under a microscope. The O mark, Δ mark and mark in Table 2 indicate good, average and poor stripping force respectively.

2) Air-knife photoresist stripping capabilities

ITO film was coated on 7×7 cm bare glass and then, the photoresist layer was formed to the thickness of 1300 Å. It was exposed, developed and etched to a certain pattern. For the treatment of 5000 such glasses, it was arranged that the stripping compositions include 1% by weight of photoresist particles, and for treating 10000 glasses, 2% by weight of photoresist particles were included. The stripping compositions were heated at the temperature range of 50 to 70° C. Thereafter, 20 ml of each stripping composition was dropped on the glass 30 seconds later, air knife processing with the pressure of 1 kgf/cm$^2$ was applied. The photoresist-stripped glasses were washed in deionized water for 30 seconds and dried. The results were observed by a naked eye first and by a microscope later. Table 2 shows the results. The experiment was conducted twice. The O mark, Δ-mark and X-mark in Table 2 indicate good, average and poor air-knife photoresist stripping capabilities respectively.

TABLE 2

| | Temperature ° C. | Stripping Force 150° C. | 160° C. | 170° C. | 180° C. | Air knife capability 5000 wafers First | Second | 10000 wafers First | Second |
|---|---|---|---|---|---|---|---|---|---|
| Comparative Example 1 | 70 | ○ | ○ | ○ | ○ | Δ | X | X | X |
| Com. Exp. 2 | 70 | ○ | ○ | ○ | ○ | X | X | X | X |
| Com. Exp. 3 | 50 | ○ | ○ | ○ | Δ | X | X | X | X |
| Com. Exp. 4 | 50 | ○ | ○ | ○ | ○ | X | X | X | X |
| Com. Exp. 5 | 70 | ○ | ○ | Δ | Δ | ○ | ○ | Δ | ○ |
| Com. Exp. 6 | 70 | ○ | ○ | ○ | Δ | ○ | Δ | Δ | X |
| Com. Exp. 7 | 70 | ○ | Δ | X | X | ○ | ○ | Δ | Δ |
| Com. Exp. 8 | 70 | ○ | ○ | Δ | Δ | Δ | Δ | X | X |
| Com. Exp. 9 | 70 | ○ | ○ | Δ | Δ | ○ | Δ | ○ | Δ |
| Com. Exp. 10 | 70 | ○ | ○ | Δ | Δ | Δ | Δ | X | Δ |
| Com. Exp. 11 | 70 | ○ | ○ | Δ | Δ | ○ | Δ | ○ | X |
| Com. Exp. 12 | 70 | ○ | Δ | Δ | X | Δ | Δ | Δ | ○ |
| Com. Exp. 13 | 70 | ○ | ○ | Δ | Δ | Δ | ○ | Δ | Δ |
| Com. Exp. 14 | 70 | ○ | ○ | Δ | Δ | ○ | Δ | ○ | ○ |
| Com. Exp. 15 | 70 | ○ | ○ | Δ | Δ | Δ | Δ | Δ | Δ |
| Com. Exp. 16 | 70 | ○ | ○ | Δ | X | ○ | ○ | Δ | ○ |
| Example 1 | 70 | ○ | ○ | ○ | Δ | Δ | ○ | ○ | Δ |
| Example 2 | 70 | ○ | ○ | ○ | ○ | ○ | ○ | Δ | ○ |
| Example 3 | 70 | ○ | ○ | ○ | ○ | ○ | Δ | Δ | ○ |

The stripping compositions for comparative examples 1 to 4 and 6 exhibited very good stripping force and poor air knife photoresist stripping capabilities, in contrast to the compositions for comparative examples 5, 7, 9, 11, 14 and 16 that displayed poor stripping force and good air knife stripping capabilities. The compositions for comparative examples 8, 10, 12, 13 and 15 showed poor stripping force and poor air knife stripping capabilities. Inferences can be drawn that the increased amount of MIPA and MEA and the inclusion of ethyldiglycol and DPGME reduce air knife stripping capabilities.

3) Contact Angle

The compositions that showed good stripping force and air knife stripping capabilities were selected and they were applied on the photoresist layer to measure the respective contact angle. Table 3 and FIG. 1 show the results. The measurement of the contact angle was conducted as follows:

The 7×7 cm bare glass was coated with ITO film, and then, photoresist was formed to the thickness of 1300 Å. The stripping compositions were made to include 1 weight % of photoresist particles for the treatment of 5000 such glasses, and 2 weight % of photoresist particles for treating 10000 glasses. The stripping compositions were heated at the temperature of 70° C. Thereafter, 5 $\mu$l of the stripping compositions was applied on the photoresist-coated glass. 50 photos were taken per 2 seconds to measure the width and height of the drops on the glass and the contact angle was calculated.

TABLE 3

| | Contact Angle(°) Initial Contact angle(A) | Changed Contact Angle(B) | The Gap = (A) − (B) |
|---|---|---|---|
| Comparative Example 1 | 34.5 | 17.2 | 17.3 |
| Comparative Example 2 | 35.2 | 18.3 | 16.7 |

TABLE 3-continued

| | Contact Angle(°) Initial Contact angle(A) | Changed Contact Angle(B) | The Gap = (A) − (B) |
|---|---|---|---|
| Comparative Example 4 | 30.3 | 18.2 | 12.1 |
| Comparative Example 5 | 22.9 | 15.1 | 7.8 |
| Comparative Example 6 | 27.5 | 17.3 | 10.2 |
| Comparative Example 12 | 30.4 | 19.6 | 10.8 |
| Comparative Example 15 | 30.5 | 20.9 | 9.6 |
| Comparative Example 16 | 28.5 | 17.2 | 11.3 |
| Comparative Example 17 | 28.3 | 17.1 | 11.2 |
| Example 1 | 28.3 | 20.9 | 7.4 |
| Example 2 | 28.4 | 21.6 | 6.8 |
| Example 3 | 28.1 | 21.0 | 7.1 |

The compositions for comparative examples showed a large contact angle compared to the compositions for examples. And the contact angles for the compositions for comparative examples changed much as time passes. Due to their large contact angles and the difference of the surface tension as time passes, these stripping compositions were not desirable. Whereas, the stripping compositions for examples 1 to 3 showed a good stripping force and the respective contact angle was small and changed little as time passes. Therefore, the compositions for examples were suitable for the air knife stripping process and the dipping process.

4) Evaporation rate

The evaporation rate of the compositions for example 2 and comparative examples 15 and 17 showing a good stripping force and airknife stripping capabilities were measured. Table 4 shows the results. First, 40 ml of the respective stripping composition was put into glass vials. Then, the vials were oil-bathed at the temperature of 70° C. for 48 hours. The loss of weight due to evaporation was measured when 24 hours have lapsed and when 48 hours have lapsed.

TABLE 4

| | Right After | | After 24 Hours | | After 48 hours | |
|---|---|---|---|---|---|---|
| | Weight (g) | Loss (%) | Weight (g) | Loss (%) | Weight (g) | Loss (%) |
| Example 2 | 40 | 0 | 38.48 | 3.8 | 36.64 | 8.4 |
| Comparative Example 15 | 40 | 0 | 37.41 | 6.48 | 34.64 | 13.4 |
| Comparative Example 17 | 40 | 0 | 38.27 | 4.83 | 36.14 | 9.65 |

As shown in Table 4, the evaporation rates for compositions of Comparative Examples 15 and 17 were greater than that of Example 2. A high evaporation rate raises such problems as a loss of stripping compositions and the release of toxic gases into the air. The Comparative Example 15 in particular showed a high evaporation rate due to the DMAC having a very low boiling point.

5) Al elution rate

This experiment was conducted to investigate corrosiveness of the stripping compound. The compounds for examples 1 and 3 and comparative examples 4 and 15 were bathed for 72 hours and the amount of Al eluted was measured.(REF) The selected compounds were applied on 2000 and 4000 Al-coated glasses and the amount of the eluted Al was measured. Table 5 shows the results.

TABLE 5

| Example 4 | Comparative Example 14 | Comparative Example 15 | Example 1 | Example 3 |
|---|---|---|---|---|
| REF | 0.14 | 0.25 | 0.23 | 0.28 |
| 2000 wafers | 0.62 | 0.49 | 0.38 | 0.44 |
| 4000 wafers | 0.96 | 0.72 | 0.57 | 0.53 |

The compounds for experiments eluted less amount of Al than the compounds for comparative examples.

EXAMPLE 4

This example is to compare the characteristics of stripping compositions with and without a surfactant. The stripping composition for the Example 2 and the same composition with the surfactant of 0.1 by weight of F14 and LP 100 in proportion to 100 by weight of the compound were prepared for comparison. The air knife stripping capabilities, rinsing effect and degree of bubble formation of the respective compositions were measured and compared.

Figure 2A:
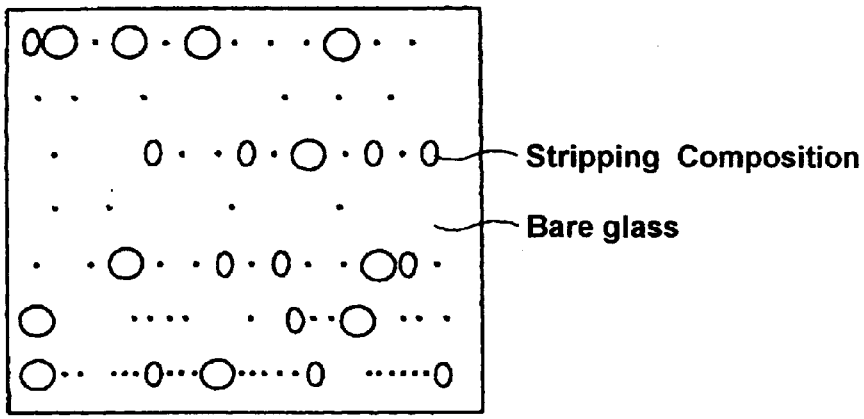
FIGS. 2*a* and 2b show the shapes of stripping composition that has been coated on bare glass and undergone the air-knife process with and without an addition of surfactant.
Figure 2B:
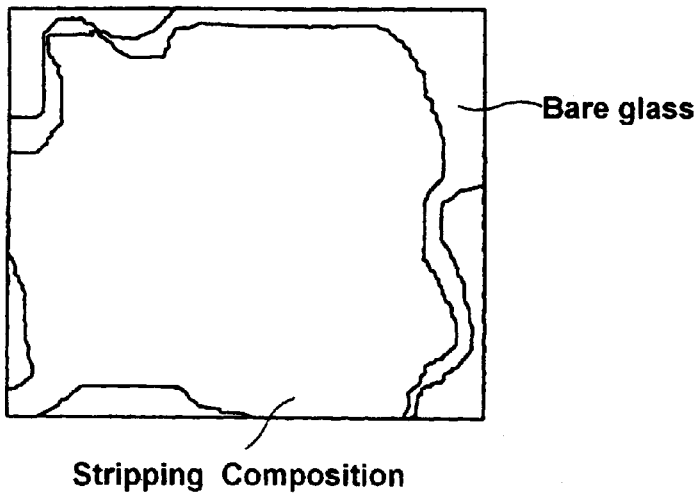

To investigate the air-knife stripping capabilities, each stripping compound was coated on a bare glass and 1 kgf/cm$^2$ of air was applied. The stripping compounds on the surface of glass were observed as shown in FIG. 2*a* and FIG. 2*b*. The shapes of the stripping composition without a surfactant on the glass resembled coagulated water drops while the composition with a surfactant formed a uniform layer. Thus, it can be understood that the added surfactant increases the stripping composition's adhesion with the glass, enabling the formation of a uniform layer. A uniform layer prevents a particle formation on the glass caused by the hardening of the stripper composition.

To investigate the rinsing effect of the stripping composition with and without a surfactant, a bare glass was immersed in each composition, rinsed and dried. After drying the bare glass, water was dropped on the glass. The stripping composition without a surfactant took a longer period of time until the water drops were uniformly coated on the glass. Therefore, it can be concluded that the stripping composition with a surfactant shows better rinsing effect .

To investigate the degree of bubble formation of each stripping composition, ASTM D896 method was adopted. For the present experiment, gas was supplied at a rate of 85 ml/min and the amount of the stripping composition used was 85 ml. The temperature was maintained at 21° C. and the humidity in the air was 40%. After supplying gas for 1 minute, the volume of the stripping compositions and the bubble formation were observed. As a result, the compositions with and without a surfactant effectively prevented the formation of bubbles: the volume of the compositions after the gas was supplied was 107 ml and 99 ml respectively and the bubbles were all eliminated within 150 seconds. The above experiments conducted for comparison of the stripping compositions with and without a surfactant showed that the composition with a surfactant is more desirable for use in the air knife stripping process.

The photoresist stripping composition of the present invention showed a good stripping force, prevented a corrosion of metals, maintained the surface tension between the stripping compositions and various LCD films, and therefore, was able to leave no photoresist particles on the substrate, which is suitable for a single wafer treatment method using an air knife process as well as for a dipping method.

Furthermore, the composition was able to be used for a longer period of time (3 times) due to its low evaporation and, it was reusable, thus doing little harm to the environment. The composition also prevented the formation of impurities on bare glass. The photoresist stripping composition according to the present invention enhances the performance of the photoresist stripping process and are useful for a single wafer treatment method for LCD circuits using an air knife process.

What is claimed is:

1. A photoresist stripping composition, comprising:

5–15 weight % of alkanolamine;

35–55 weight % of sulfoxide or sulfone compound; and

35–55 weight % of glycolether.

2. The photoresist stripping composition according to claim 1, wherein the alkanolamine includes at least one compound selected from the group consisting of monoisopropanolamine and monoethanolamine.

3. The photoresist stripping composition according to claim 1, wherein the sulfoxide composition includes at least one compound selected from the group consisting of dimethylsulfoxide and diethylsulfoxide and wherein the sulfone compound includes at least one compound selected from the group consisting of diethylsulfone and dimethylsulfone.

4. The photoresist stripping composition according to claim 1, wherein the glycolether includes at least one compound selected from the group consisting of ethyldiglycol, methyldiglycol and butyldiglycol.

5. The photoresist stripping composition according to claim 1, wherein the composition further includes at least one surfactant selected from the group expressed by formula 1 (where n is 0, 1, 2, 3 . . . 10.).

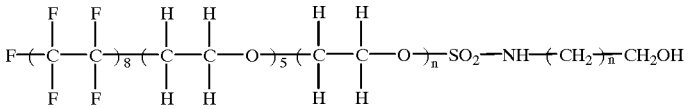

6. The photoresist stripping composition according to claim 1, wherein the composition further includes at least one compound selected from the group consisting of 1–10 weight % of tetra methyl ammonium hydroxide and 3–15 weight % of benzenediol.

7. The photoresist stripping composition according to claim 1, wherein the composition further includes 1–15 weight % of alkylsulfonic acid.

8. The photoresist stripping composition according to claim 1, wherein the composition comprises 10 weight % of alkanolamine, 45 weight % of sulfoxide or sulfone compound and 45 weight % of glycolether.

9. The photoresist stripping composition according to claim 1, wherein the composition is applicable to a single-wafer treatment method using an air-knife process or a dipping method for stripping a photoresist.

* * * * *